United States Patent [19]

Cavalleri

[11] 4,228,885

[45] Oct. 21, 1980

[54] COIN OPERATED ELECTRIC TIMER AUTOMATIC ELECTRIC CANDLE

[76] Inventor: Charles G. Cavalleri, 756 Third Ave., Brooklyn, N.Y. 11232

[21] Appl. No.: 7,593

[22] Filed: Jan. 29, 1979

[51] Int. Cl.[3] ..... G07F 15/12

[52] U.S. Cl. ..... 194/9 T

[58] Field of Search ..... 194/9 T, 9 R; 200/DIG. 3, 179, 6 R, 244, 51 R

[56] References Cited

U.S. PATENT DOCUMENTS 3,174,024 3/1965 Strother et al. ..... 200/244

*Primary Examiner*—Stanley H. Tollberg

*Attorney, Agent, or Firm*—Richard L. Miller

[57] ABSTRACT

A coin operated electric lamp, including an electric circuit, having a plug for connection to a household electric power supply; the circuit including a switch activated by a deposited coin, so to close the circuit to an incandescent lamp bulb and to a motor in parallel to the lamp, the motor driving a spiral cam which, upon completing a rotation, pushes the switch into an open position so to stop the motor and turn out the light bulb.

6 Claims, 9 Drawing Figures

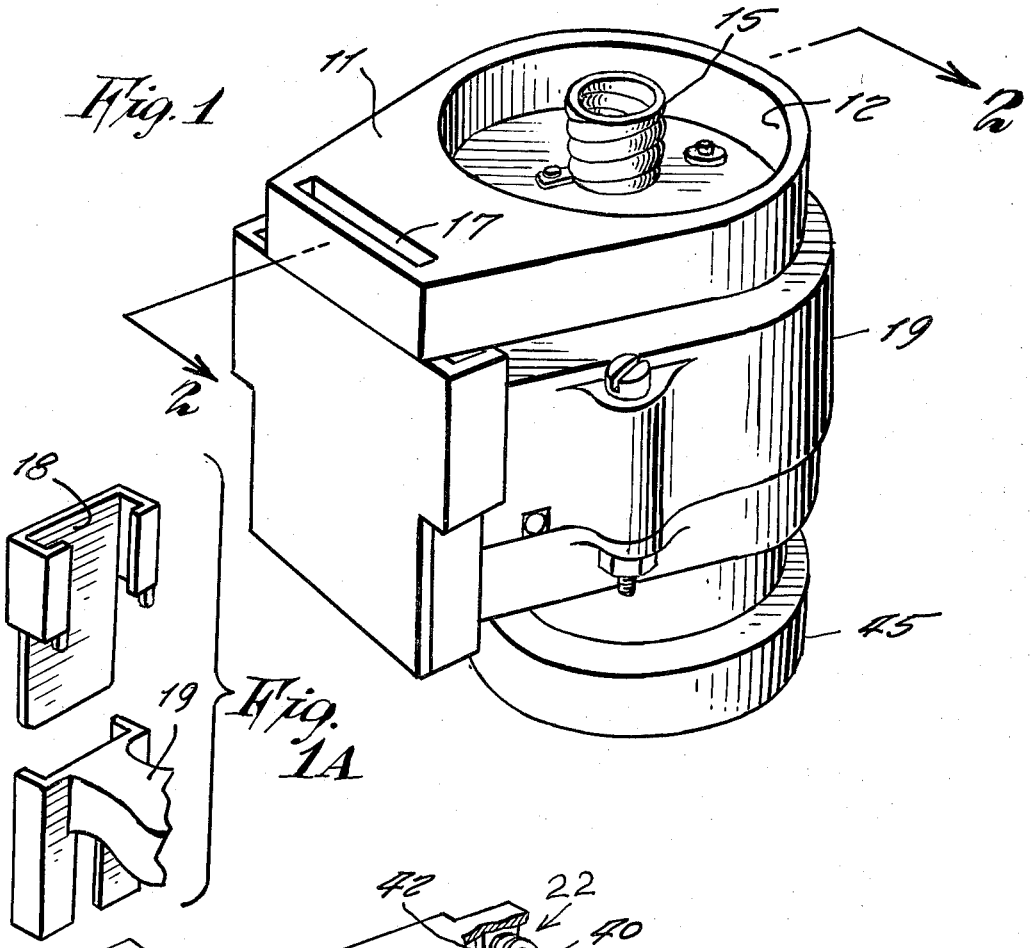
Fig. 1
11
15
12
2
17
19
2
45
18
19
Fig. 1A
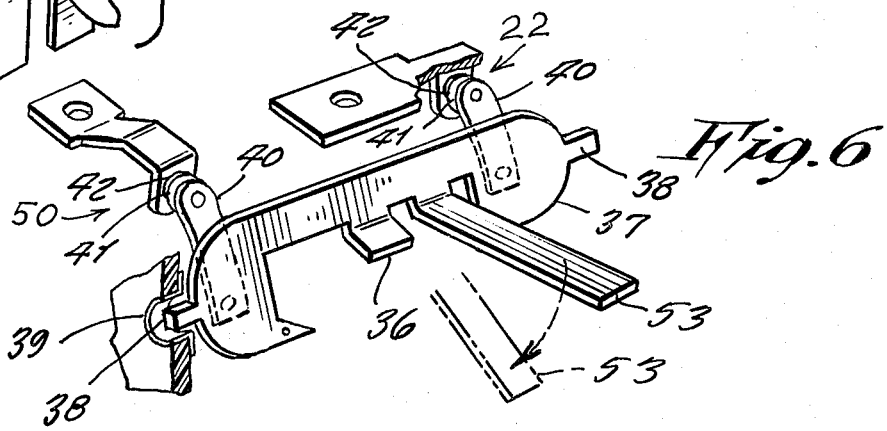
Fig. 6
42
22
40
41
40
42
50
41
38
37
39
36
53
38
53
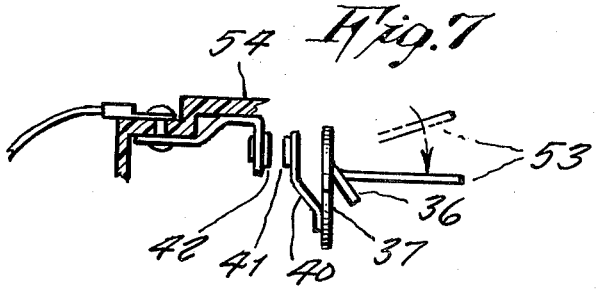
Fig. 7
54
53
36
42
41
40
37

COIN OPERATED ELECTRIC TIMER AUTOMATIC ELECTRIC CANDLE

BACKGROUND OF THE INVENTION

This invention relates generally to electric votive lamps such as are used in churches in lieu of burning wax candles.

The present invention is an improvement on applicant's previous U.S. Pat. No. 2,863,547, granted on Dec. 9, 1958. In the former patent, the applicant has presented an electric lamp that is much safer than a burning candle, so that the danger of a fire to a person and to a church building has been practically eliminated. However, the construction of the original lamp has, in time, been structurally improved, and is the subject of the present application.

SUMMARY OF THE INVENTION

A principal object of the present invention is to provide a coin operated electric lamp, which includes all the advantageous features of the original lamp but which is structurally improved, so to be easier and less expensive to manufacture and which is operationally improved, so that it will last a longer period of time, trouble free, without wearing out.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

FIG. 1 is a perspective view of the present invention.

FIG. 1A is a perspective view of the coin slot structure thereof shown with components disassembled.

FIG. 6 is a bottom perspective view of a pivotable contact arm of the switch in relation to the stationary contacts of the switch.

FIG. 7 is an end view of the structure shown in FIG. 6.

PREFERRED EMBODIMENT OF THE INVENTION

Figure 2:
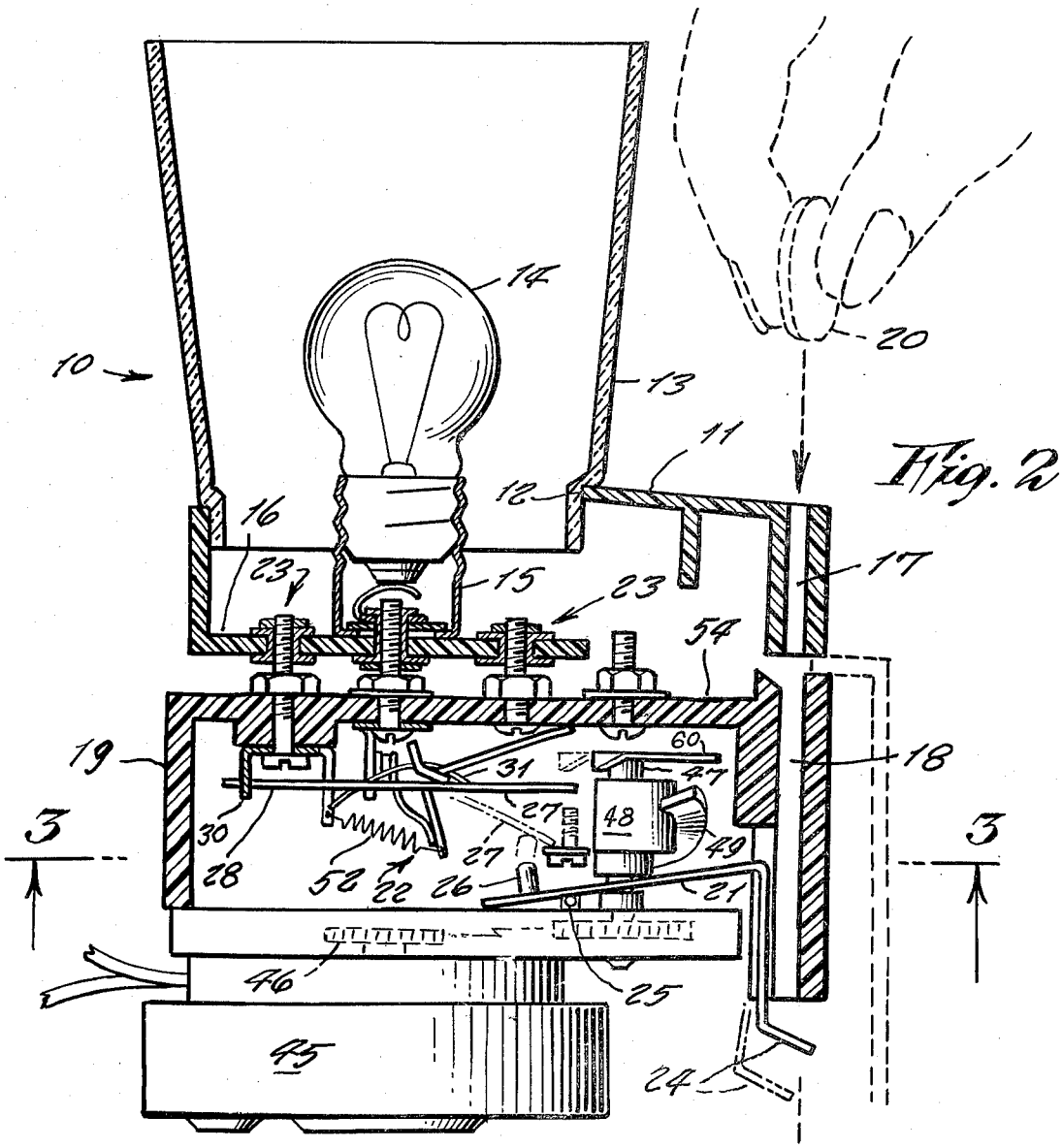
FIG. 2 is an enlarged cross-sectional view taken on line 2—2 of FIG. 1.

Referring now to the drawings in greater detail, the reference numeral 10 represents a coin operated electric timer. according to the present invention, wherein there is a molded plastic upper case 11 having an opening 12 on its top and into which an upwardly extending, generally cylindrical lamp shade 13 is fitted so to surround an electric lamp bulb 14 protruding upwardly through the opening. The lamp bulb is screwed in a socket 15 mounted upon a bottom wall 16 of the upper case.

The upper case includes a coin slot 17 that aligns above a coin slot 18 of a lower, molded plastic case 19, so that a coin 20 dropped into the slot 17 travels down so as to activate a coin operated lever 21 therebelow, and thus trip a switch mechanism 22 contained in the lower case. The coin falls into a collection box.

The lower case is secured to the upper case by means of bolt assemblies 23 attached therebetween.

The lever 21 is bent up at one end so to form a finger 24 upon which the falling coin strikes so to rock the lever about a pivot pin 25 in order that a button 26 upon an opposite end of the lever is swung upwardly against an underside of a pad 27 on one end of a copper leaf spring 28 of the switch mechanism.

Figure 4:
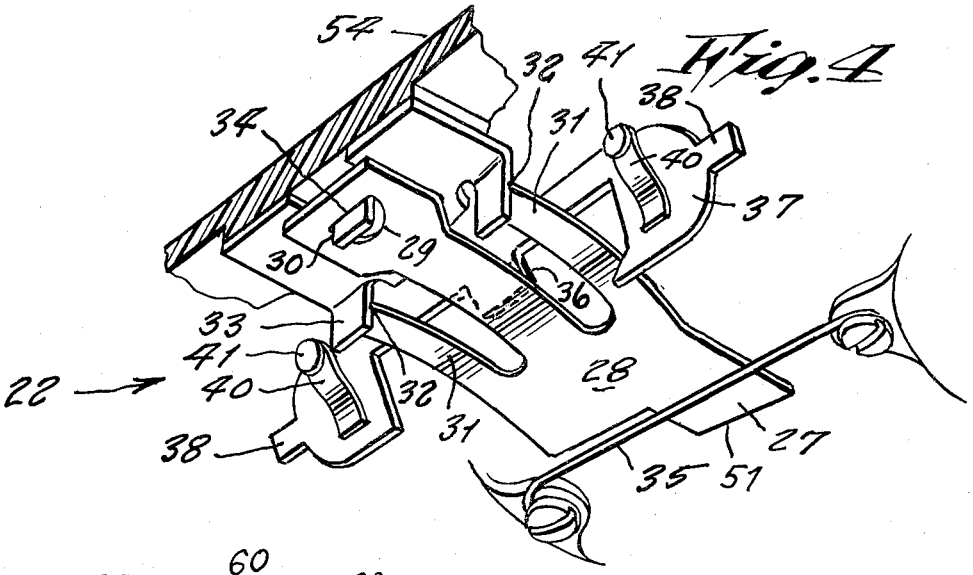
FIG. 4 is a fragmentary bottom perspective view of the switch mechanism thereof.
Figure 5:
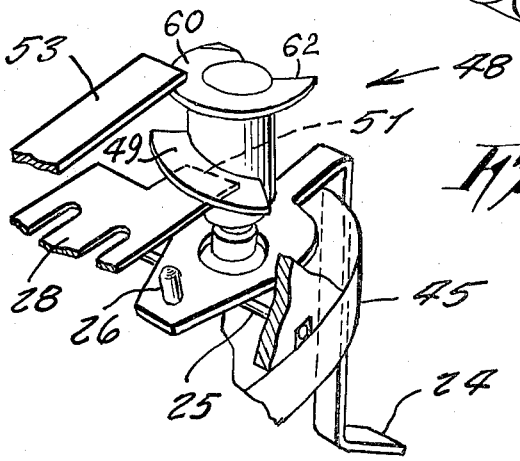
FIG. 5 is a bottom perspective view of a motordriven spiral cam mechanism thereof.

The leaf has a hole 29 at the opposite end anchored on a stationary post 30, and the leaf spring includes a pair of tongues 31 which at their ends are pivoted in notches 32 of stationary posts 33, the tongues being flexed into a bent shape, as shown in FIGS. 2 and 4, so that the tension of the flexed tongues causes the leaf spring to snap into opposite pivoted directions as the spring pivots about a fulcrum 34 and over-rides an intermediate balance point midway along its pivotal travel.

In one pivoted position A, shown in FIGS. 2 and 4, the spring 28 rests against a stationary wire or bar 35.

In its opposite pivoted position, the spring has pushed against a tongue 36 formed along a punched out steel arm 37, having opposite ends 38 supported pivotally in bearing openings 39 of lower case 19. A pair of copper leaf springs 40 riveted at one end on the arm 37, each carries a contact 41 on its other end, so that when the leaf spring 28 strikes the arm 37, the arm pivots in bearing openings 39, thus causing the contacts 41 to each engage a stationary contact 42 that are electrically connected to the motor and the lamp bulb socket. The contacts 41 are connected to an electric power source, obtained through a plug 43.

Figure 8:
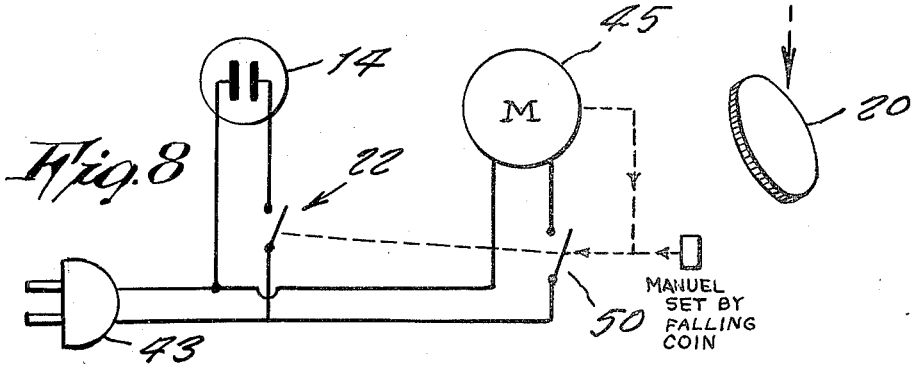
FIG. 8 is an electric diagram of the coin operated electric timer.
Figure 3:
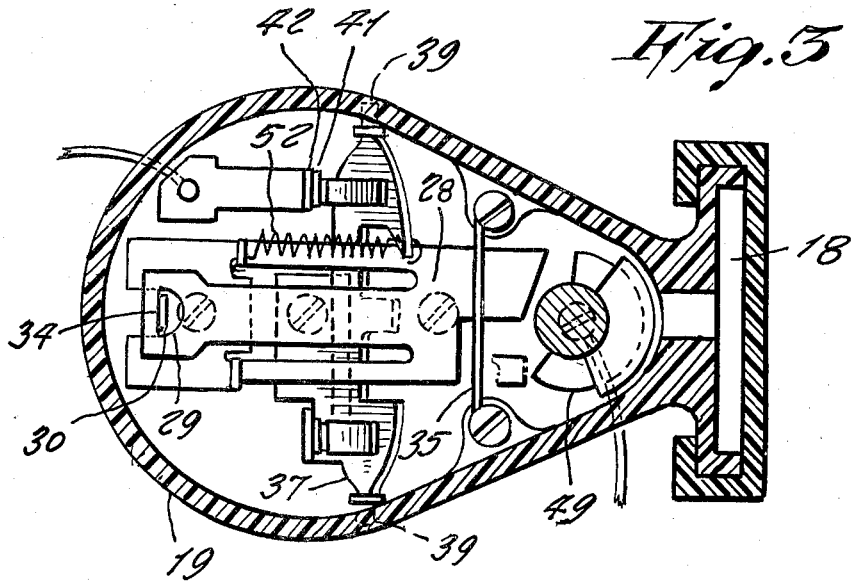
FIG. 3 is a cross-sectional view taken on line 3—3 of FIG. 2.

An electric circuit 44 of the device 10 also includes a motor 45 mounted on an underside of the lower case 19, the motor driving a gearing 46 which rotates a shaft 47 of a cam unit 48, so as to rotate a spiral cam 49 carried thereon. The motor is in parallel circuit with the lamp bulb, as shown in FIG. 8. Thus motor is in circuit with a switch 50 which is mechanically connected to the switch mechanism 22 in order to operate simultaneously the lamp bulb 14.

It is now evident that the present invention can be installed inside churches or other houses of worship where persons may drop a coin in a slot so as to light up the lamp while the person is in prayer or meditation. The lamp bulb remains lighted while the motor rotates the spiral cam a full 360 degrees after which the cam has moved into a position under a tab 51 of the leaf spring 28 so as to cause the leaf spring to snap pivotally back into its original position, and thus release its hold against the arm 37, thus permitting a tension coil return spring 52 to pull the arm back to its original pivoted position with the arm contacts 41 disengaging the stationary contacts 42. It is to be noted that a lug 53 formed on the arm 37 serves as a stop abutting against an underside of lower case top wall 54 when the arm is in the pivoted position wherein the contacts are engaged.

However, after the cam 49 has rotated a sufficient amount to cause spring 28 to pivot about fulcrum 34 and be biased in such a direction that contact would attempt to open disc cam 60 has also rotated so that it interferes with lug 53 and thereby prevents the mechanism from toggling back to its original position with the contacts open. As the motor continues to rotate cam unit 49, eventually lug 53 drops off the rear edge 62 of cam 60 and the contacts snap open. It should be understood that cam 60 greatly adds to the reliability and repeatability of the mechanism because it allows spiral cam 49 to store an excess of bias energy in spring 28 so that when lug 53 is released, the contact opens quite rapidly and with a minimum amount of arcing.

Thus there is provided a coin operated electric timer.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A coin operated electric timer, comprising in combination, an upper and a lower case secured together, a coin slot in said cases receiving a coin, a pivoted lever tripped by said coin, a pivoted arm carrying two contacts, being pivoted by said lever so as to contact a pair of stationary contacts connected to a socket fitted with a lamp bulb, and said arm contacts being connected to a power source plug.

2. The combination as set forth in claim 1, wherein an electric motor mounted under said lower case is in circuit with a switch and said power source plug, a gear train driven by motor, and a spiral cam rotated by said gear train, said cam being aligned with said arm for pivoting back to an original position with said arm contacts and stationary contacts being disengaged.

3. The combination as set forth in claim 2 wherein said lamp bulb is surrounded by a cylindrical lamp shade mounted on top of said upper case.

4. An electric timer comprising, in combination, a case, a pivoted arm carrying two contacts contained in said case, said pivoted arm having two stable states, and toggling means for pivoting, said pivoted arm between its two stable states such that said contacts are closed against a pair of stationary contacts in one state and open in the other state, and which further comprises a motor unit mounted on said case, which rotates a first cam and a second cam wherein said first cam stores energy in a spring means and said second cam releases energy in said spring means.

5. The combination as set forth in claim 4 wherein said spring means is coupled with said pivoted arm carrying two contacts in such a way that said contacts are held closed against said pair of stationary contacts until the energy in said spring means is released by said second cam.

6. The combination as set forth in claim 5 wherein the electrical energy operating said motor unit is interrupted when said contacts are opened, thereby causing said motor unit to stop running.

* * * * *